US006910594B2

(12) United States Patent
Foley et al.

(10) Patent No.: US 6,910,594 B2
(45) Date of Patent: Jun. 28, 2005

(54) METHOD AND APPARATUS FOR STORING MILK

(75) Inventors: Richard M. Foley, Medfield, MA (US); James J. Britto, Westport, MA (US); Ryan Shafer, Uxbridge, MA (US)

(73) Assignee: The First Years Inc., Lake Forest, CA (US)

( * ) Notice: Subject to any disclaimer, the term of this patent is extended or adjusted under 35 U.S.C. 154(b) by 0 days.

(21) Appl. No.: 10/299,968

(22) Filed: Nov. 19, 2002

(65) Prior Publication Data

US 2004/0094498 A1 May 20, 2004

(51) Int. Cl.[7] ..... A61J 9/00; A61J 11/00

(52) U.S. Cl. ..... 215/11.1; 215/11.3; 215/11.6; 220/495.03

(58) Field of Search ..... 215/11.1, 11.3, 215/11.6; 383/60, 66; 220/495.06, 495.03

(56) References Cited

U.S. PATENT DOCUMENTS

| | | | | | |
|---|---|---|---|---|---|
| 985,328 | A | * | 2/1911 | Decker | 215/11.6 |
| 1,224,778 | A | | 5/1917 | Palm | |
| 1,834,978 | A | * | 12/1931 | Shapiro | 383/60 |
| 2,200,395 | A | * | 5/1940 | Lobl | 383/66 |
| 2,314,650 | A | | 3/1943 | Madsen | |
| 2,343,512 | A | * | 3/1944 | Lobl | 383/60 |
| 2,558,195 | A | * | 6/1951 | Pearl | 215/11.3 |
| 2,987,209 | A | * | 6/1961 | Leonard | 214/11.3 |
| 3,406,853 | A | * | 10/1968 | McLeod | 215/11.3 |
| 3,776,408 | A | * | 12/1973 | Wald | 215/11.3 |
| 3,790,021 | A | | 2/1974 | Bailey | |
| 3,851,781 | A | * | 12/1974 | Marco | 215/11.3 |
| 3,977,405 | A | * | 8/1976 | Yanase | 604/74 |
| 4,501,585 | A | | 2/1985 | Friedman | |
| 4,573,969 | A | * | 3/1986 | Schlensog et al. | 604/74 |
| 4,678,092 | A | * | 7/1987 | Rane | 215/11.3 |
| 4,786,285 | A | | 11/1988 | Jambor | |
| 4,834,732 | A | | 5/1989 | Steer et al. | |
| 5,005,733 | A | * | 4/1991 | Stoody | 222/105 |
| 5,295,957 | A | * | 3/1994 | Aida et al. | 604/74 |
| 5,356,016 | A | * | 10/1994 | Wiedemann | 215/11.3 |
| 5,356,398 | A | | 10/1994 | Willis | |
| 5,358,476 | A | * | 10/1994 | Wilson | 604/74 |
| 5,385,251 | A | | 1/1995 | Dunn | |
| 5,806,711 | A | * | 9/1998 | Morano et al. | 221/33 |
| D402,196 | S | | 12/1998 | Lynch | |
| D406,348 | S | | 3/1999 | Kochnke | |
| 6,000,848 | A | | 12/1999 | Massioui | |
| 6,050,432 | A | | 4/2000 | Kochnke | |
| 6,138,847 | A | * | 10/2000 | Johnson | 215/11.1 |
| 6,616,000 | B1 | * | 9/2003 | Renz | 215/11.1 |
| 2002/0033199 | A1 | | 3/2002 | Lafond | |

FOREIGN PATENT DOCUMENTS

| | | | | |
|---|---|---|---|---|
| WO | WO90/14066 | * | 11/1990 | 215/11.3 |
| WO | WO 94/26231 | | 11/1994 | |
| WO | WO 97/27119 | | 7/1997 | |
| WO | WO9942380 | * | 8/1999 | |

* cited by examiner

*Primary Examiner*—Sue A. Weaver
(74) *Attorney, Agent, or Firm*—Fish & Richardson P.C.

(57) ABSTRACT

A method of and apparatus for nursing in which a container is filled with milk. The container has flexible membrane forming a pouch for holding the milk. A rim defines a stable opening of the pouch, and a lid is secured to the rim to cover the opening. The container is inserted into a nursing device and the lid is opened to expose the milk. A nursing nipple is secured to the nursing device with the container disposed therein.

16 Claims, 10 Drawing Sheets

METHOD AND APPARATUS FOR STORING MILK

TECHNICAL FIELD

This invention relates to a method and apparatus for storing and using breast milk.

BACKGROUND

It is common to extract or express human breast milk and store it before using it to feed an infant. A breast pump may be used to collect expressed breast milk into a receptacle. The milk may then be stored in the receptacle by removing the receptacle from the breast pump and sealing the receptacle with a cover. Alternatively, the milk is transferred from the receptacle to a reusable storage container. Often, the breast milk must be transferred to a feeding device, such as a nursing bottle or a nursing bottle liner, before being used to feed an infant. Other times, the reusable storage container or the breast pump receptacle with the breast milk still in it may be combined with a nursing nipple and collar to form a feeding device.

It is desirable that all containers coming into contact with breast milk be sterile before each use.

SUMMARY

The invention, in various aspects, features a container with a flexible membrane and a cover. Advantageously, the container can, in several circumstances, also be employed to collect and store breast milk and to line a nursing device.

One aspect of the invention features a method of nursing. The method includes filling a container with milk. The container has flexible membrane forming a pouch for holding the milk. A rim defines a stable opening of the pouch, and a lid is secured to the rim to cover the opening. The container is inserted into a nursing device and the lid is opened to expose the milk. A nursing nipple is secured to the nursing device with the container in the nursing device.

In some cases, the lid is integrally attached to the rim and, for example, the method includes removing the lid from the container. In other cases, the method includes storing the milk in the flexible container for a period of time in between filling the container and opening the lid. In still other cases, the method includes freezing the milk. In other cases, the method includes inserting an empty container into a breast pump and extracting milk from a breast into the container.

In some cases, the rim has an upper surface, a sealing lip on the upper surface to form a fluid seal with the nursing nipple, an inner surface, and a sealing lip on the inner surface to form a fluid seal with the lid. In other cases, the lid has a lower surface, a wall on the inner surface, and a sealing lip on the wall to form a fluid seal with the rim. In still other cases, the flexible membrane extends from a closed end to the stable opening.

Another aspect of the invention features a nursing bottle having a nursing nipple. A liner has a flexible membrane forming a milk storage pouch joined to a rim. The rim permanently defines a stable opening of the pouch. An integral lid is formed with the rim and has a lower surface. A rigid holder is disposed about the liner and has a shoulder supporting the lower surface of the rim. A removable collar is attached to the holder to secure the rim and the nipple, and to permit fluid communication between the liner and the nipple.

In some cases, the rim has an upper surface. A sealing lip is disposed on the upper surface and is configured to form a fluid seal with the nursing nipple. The rim has an inner surface and a sealing lip disposed on the inner surface and configured to form a fluid seal with the lid. In other cases, the lid has a lower surface, a wall disposed on the inner surface, and a sealing lip disposed on the wall and configured to form a fluid seal with the rim. In still other cases, the flexible membrane extends from a closed end to the stable opening.

In another aspect, the invention features a disposable, drop-in bottle liner. An elongated container is sized to fit within a baby bottle and has a closed end and an open end. A flange extends about open end of the container and has a lower surface, an upper surface, and an inner surface bounding an opening. A lid has a perimeter wall configured to fit within the flange to form a fluid-tight seal with the inner surface of the flange.

In some cases, the bottle liner has a sealing ring disposed on and projecting from the upper surface of the flange and configured to form a fluid-tight seal with a nipple. In other cases, the baby bottle defines an opening having an inner diameter. The flange is sized to extend beyond the inner diameter and prevent the flange from entering the opening. In still other cases, the inner surface has a sealing ring forming a fluid-tight seal with the sealing ring disposed on the wall. In still other cases, the lid is integrally connected to the flange by a living hinge, while in other cases, the lid is integrally connected to the flange by a tether.

In some cases the perimeter wall of the lid defines a groove positioned to receive and engage with the inner surface of the flange of the container. In other cases, the perimeter wall of the lid includes a lip extending radially outward from a distal edge of the wall to a diameter greater than a minimum diameter of the opening. In one case, the lip engages the container to form a fluidic seal. In some cases, the perimeter wall of the lid and the opening bounded by the inner surface of the flange are substantially circular.

In another aspect, the invention features a bottle liner having stable opening. A stable opening has a rigidity sufficient to maintain a general shape under its own weight. A stable opening also has a rigidity to maintain a general shape under the weight of the contents of the bottle liner. The stable opening maintains its orientation to a wall of the bottle liner before and after filling of the bottle liner.

The invention has one or more of the following advantages. A user can collect, store, freeze, warm, and nurse using a single, sterile, disposable bottle liner. The user can perform many of the aforementioned tasks with one hand while holding an infant with the other. A lid integrally attached to a bottle liner can avoid the user having a liner without a corresponding lid.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
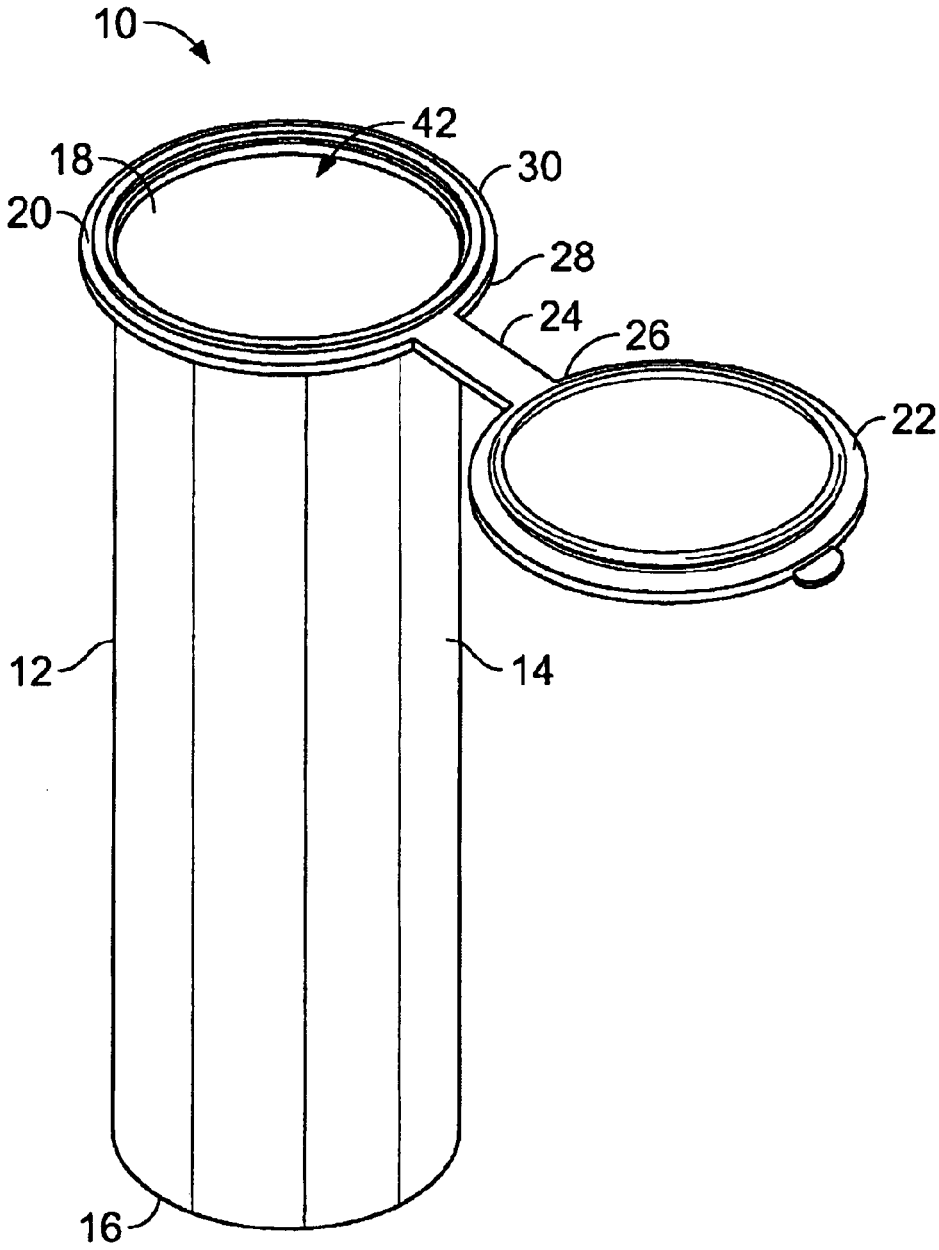
FIG. 1 shows an example of a milk storage bag.

Referring to FIG. 1, an example of a milk storage bag 10 is shown. Milk storage bag 10 has a body 12 formed from a flexible membrane 14 forming a closed end 16 and an open end 18. Rim 20 is disposed at open end 18 and stabilizes open end 18, thereby preventing it from collapsing shut. Lid 22 is integrally attached to rim 20 by a tether 24 that connects to an edge 26 of lid 22 and an edge 28 of rim 20.

In one example, body 12 has a cylindrical shape and a substantially flat closed end 16 so that storage bag 10 can stand unsupported on closed end 16. Flexible membrane 14 is rigid enough to permit storage bag 10 to be stood on closed end 16 and not collapse under the weight of rim 20 and lid 22. Flexible membrane 14 is also rigid enough to support the weight of milk within storage bag 10. Flexible membrane 14 is also flexible enough to collapse under atmospheric pressure when used as part of a nursing device, as described in more detail below. Preferably, flexible membrane 14 is a linear low-density polyethylene having a thickness of about 0.00275 inches. Those skilled in the art will understand that a wide range of materials are suitable for flexible membrane 14, including polypropylene, polyethylene, including low density polyethylene, low density polyethylene, or high density polyethylene, nylon, synthetic latex, PET, and polystyrene/catalyst combinations. Flexible material 14 is preferably clear, but may be opaque or include a thermochromatic dye, permitting flexible material 14 to change color according to the temperature of flexible material 14.

Figure 2A:
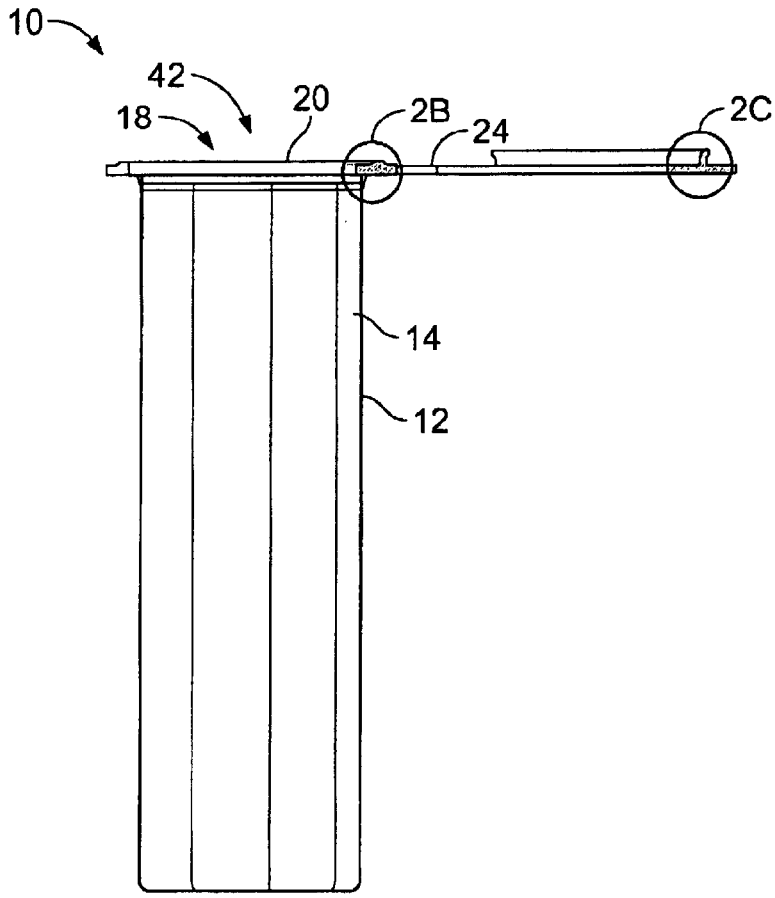
FIGS. 2A–2C show a side view and detail views of an open milk storage bag.
Figure 2B:
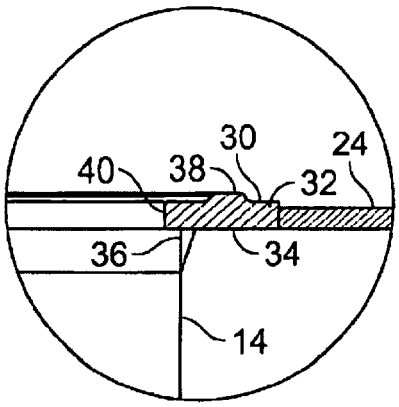

Referring to FIGS. 1, 2A, and 2B, rim 20 is disposed at open end 18 of body 12 and has an annular shape, for example. Rim 20 includes a flange 30 extending radially from open end 18 and having an upper surface 32, a lower surface 34, and an inner surface 36. Ridge 38 projects from upper surface 32 of flange 30 and allows rim 20 to form a seal with a nursing nipple, as described in more detail below. Sealing ring 40 projects from inner surface 36 into open end 18 and defines an opening 42 sized to accommodate lid 22. Rim 20 prevents open end 18 from collapsing in on itself. Rim 20 is sized to sit on top of a nursing device container and not pass into the nursing device container when storage bag 10 is deposited within it. In one example, rim 20 has an outer diameter of about 2.2 inches, and an inner diameter of about 2.0 inches.

Figure 2C:
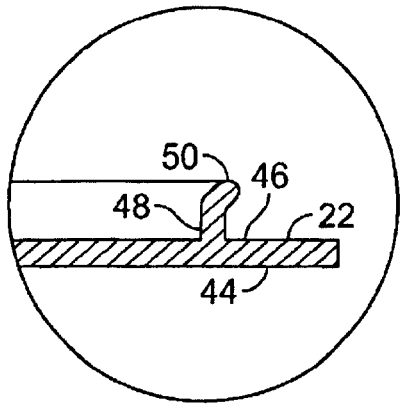

Referring to FIG. 2C, lid 22 has an outer surface 44, an inner surface 46, and a wall 48 projecting from inner surface 46. In one example, wall 48 has an annular shape and is sized to fit within sealing ring 38. Sealing ring 50 is disposed on wall 48 and extends radially outward from wall 48. Sealing ring 50 has an outer diameter larger than opening 42. Wall 48 and sealing ring 50 are flexible and allow sealing ring 50 to be pressed through opening 42.

Tether 24 integrally connects rim 20 to lid 22 allowing a user to handle storage bag 10 as a single, integrated unit. Tether 24 is constructed of the same material as rim 20 and lid 22. A user may remove lid 22 from storage bag 10 by tearing tether 24 away from flange 30.

Figure 3:
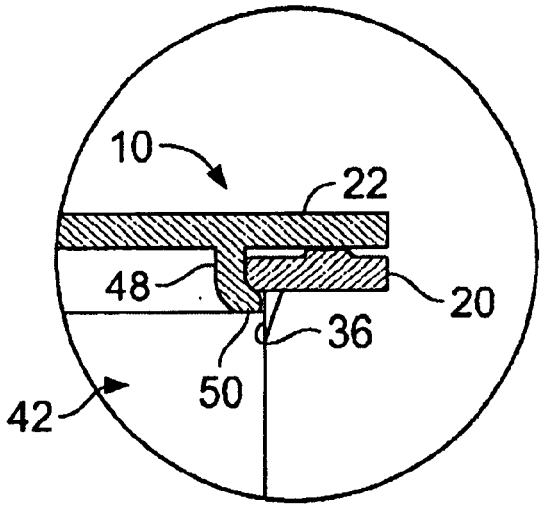
FIG. 3 shows a detail view of a first closed milk storage bag.

Referring to FIG. 3, milk storage bag 10 has been closed by positioning lid 22 over rim 20 and pressing wall 48 into and sealing ring 50 through opening 42, for example. Sealing ring 50 forms a fluidic seal against inner surface 36 and prevents leaking of breast milk from milk storage bag 10.

Figure 4:
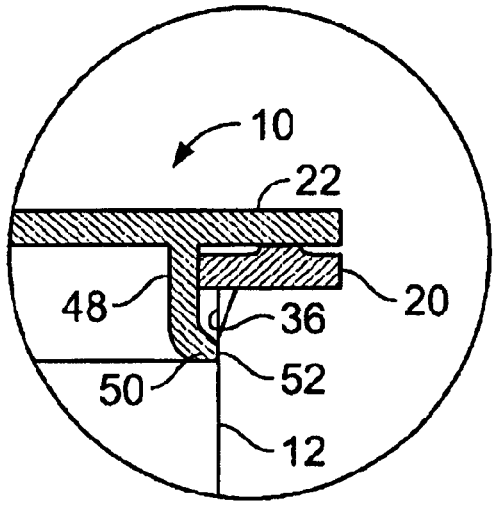
FIG. 4 shows a detail view of a second closed milk storage bag.

Referring to FIG. 4, in another example, inner surface 36 extends further into body 12 than in FIG. 3. Wall 48 and sealing ring 50 extend into opening 42 so that the fluidic seal is formed between sealing ring 50 and a portion 52 of body 12 just below the extended inner wall 36.

Figure 5:
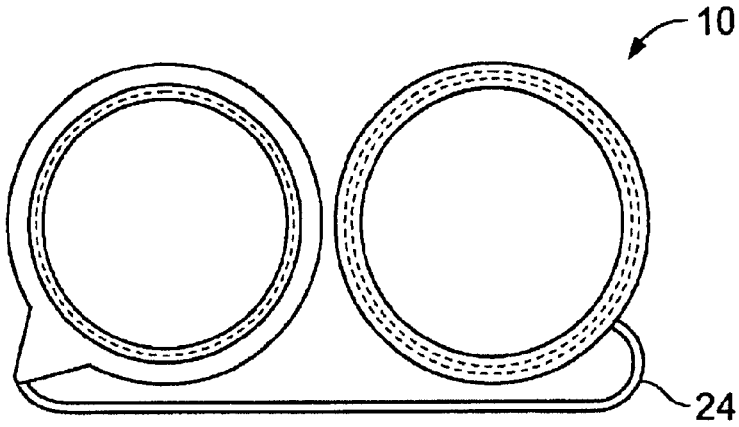
FIGS. 5–7 show top views of other examples of milk storage bags.
Figure 6:
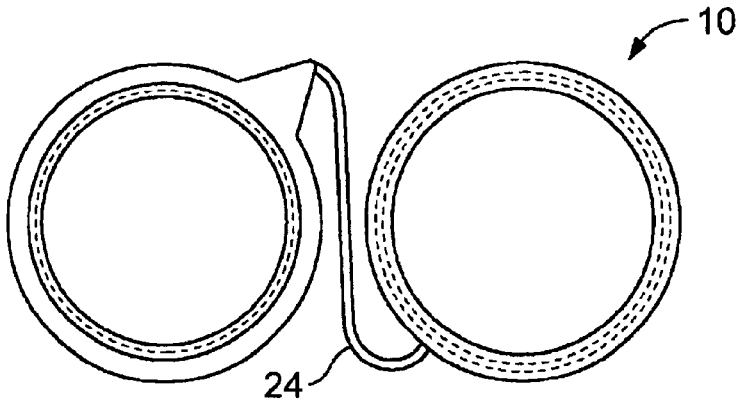
Figure 7:
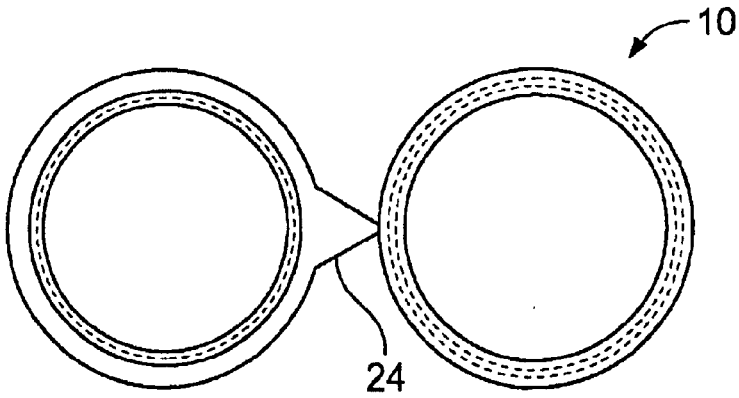

Referring to FIGS. 5–7, several examples of milk storage bags are shown with different configurations of tether 24.

Figure 8:
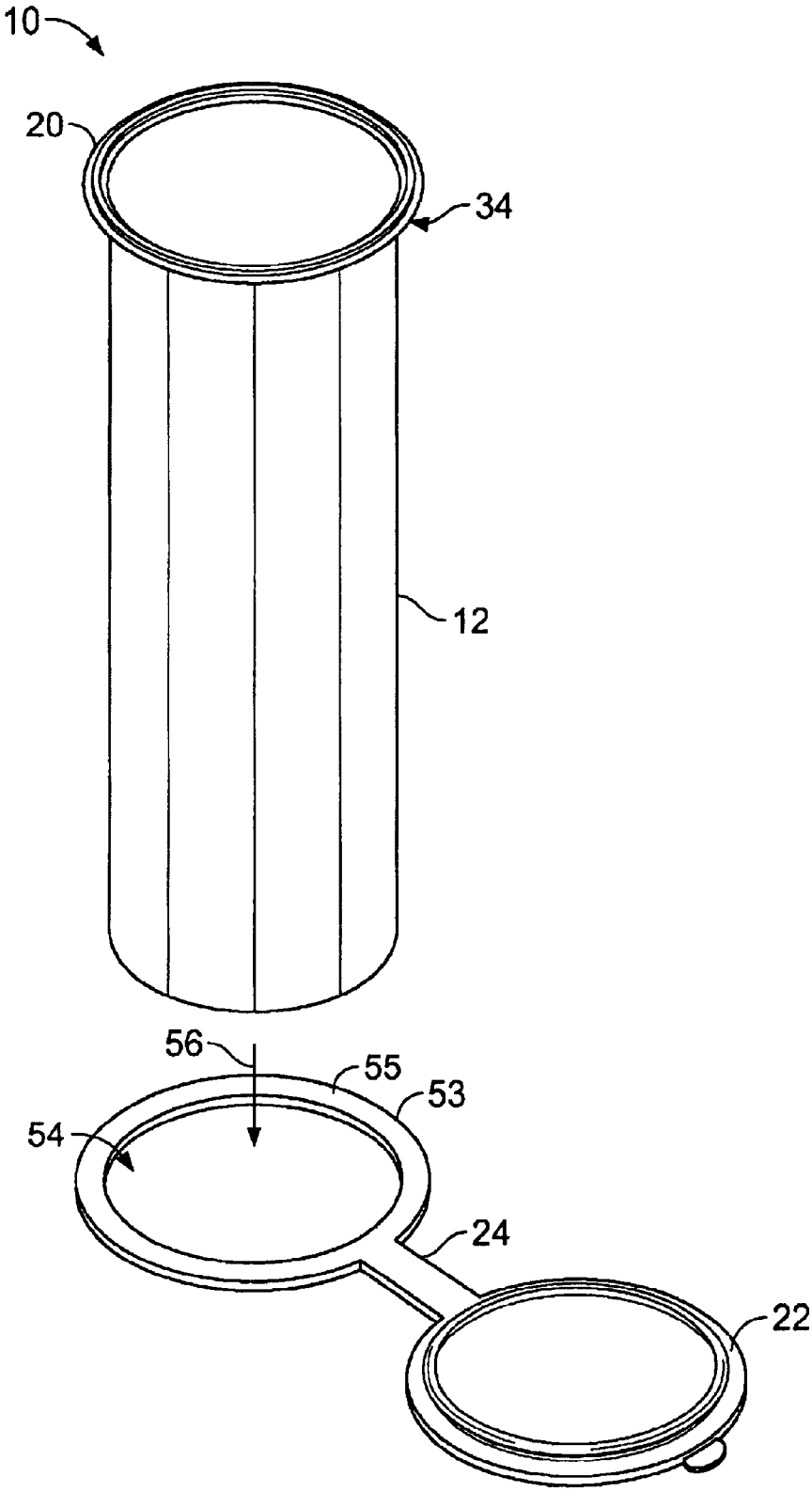
FIG. 8 shows an example of a milk storage bag and a separate lid.

Referring to FIG. 8, another example of milk storage bag 10 has a lid 22 manufactured separately from rim 20. Tether 24 joins lid 22 to a collar 53, which has a seating surface 55 and defines an opening 54 sized to accommodate body 12. Storage bag 10 is assembled by passing body 12 into opening 54 in direction 56 until seating surface 55 comes into contact with lower surface 34 or rim 20.

Storage bag 10 may be manufactured by using a blown film process to form body 12, an injection molding process to form rim 20, lid 22, and tether 24, and a heat staking process to join body 12 to rim 20. Alternatively, storage bag 10 could be manufactured using any of the following processes: injection blow molding; stretch blow molding; extrusion blow molding; Thermo form with a plug assist; dip coating; spray coating; or thin wall molding.

Figure 9:
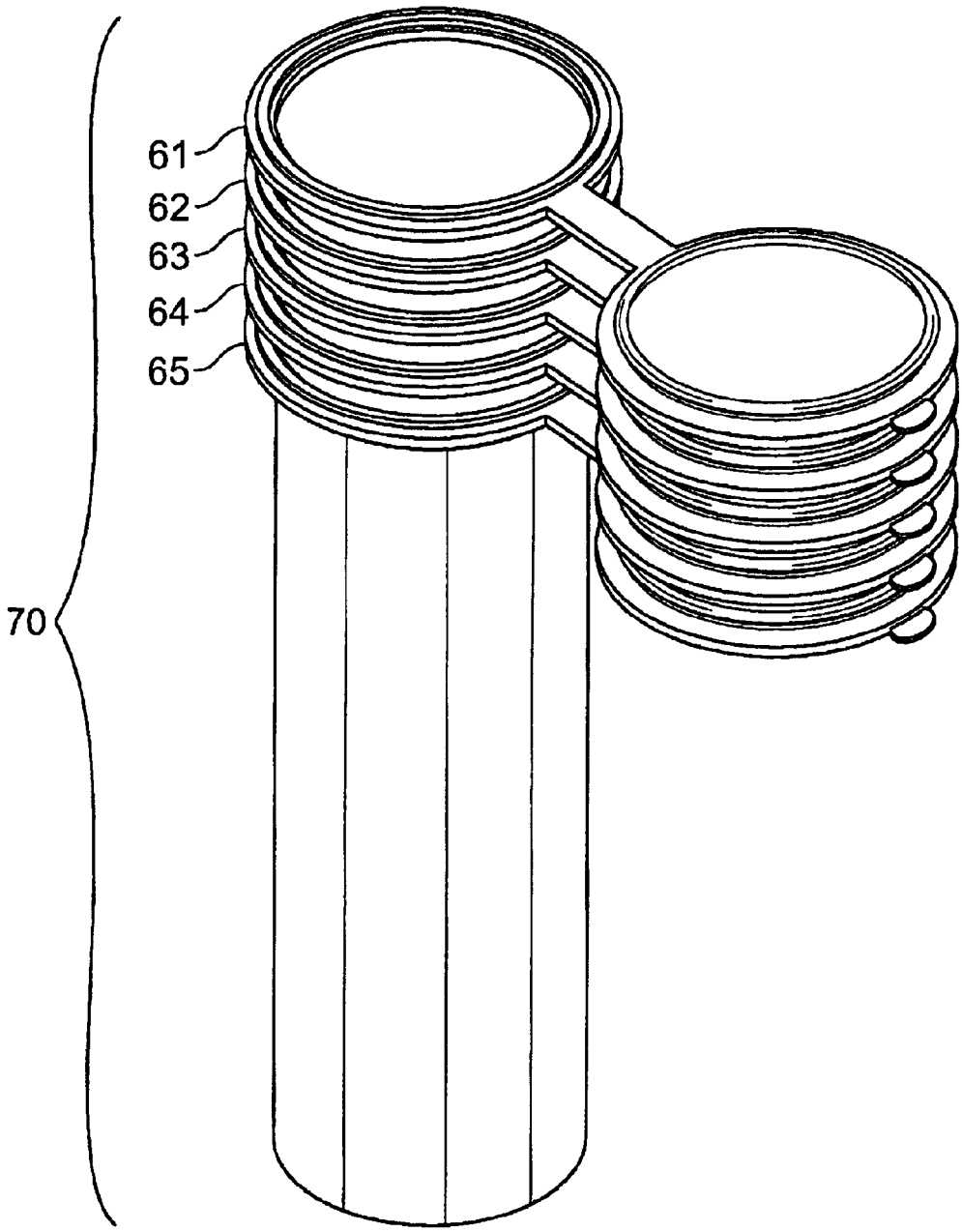
FIG. 9 shows an example of several nested milk storage bags.

Referring to FIG. 9, individual storage bags 61, 62, 63, 64, and 65 form a nested group 70 suitable for packaging and dispensing for use.

Figure 10:
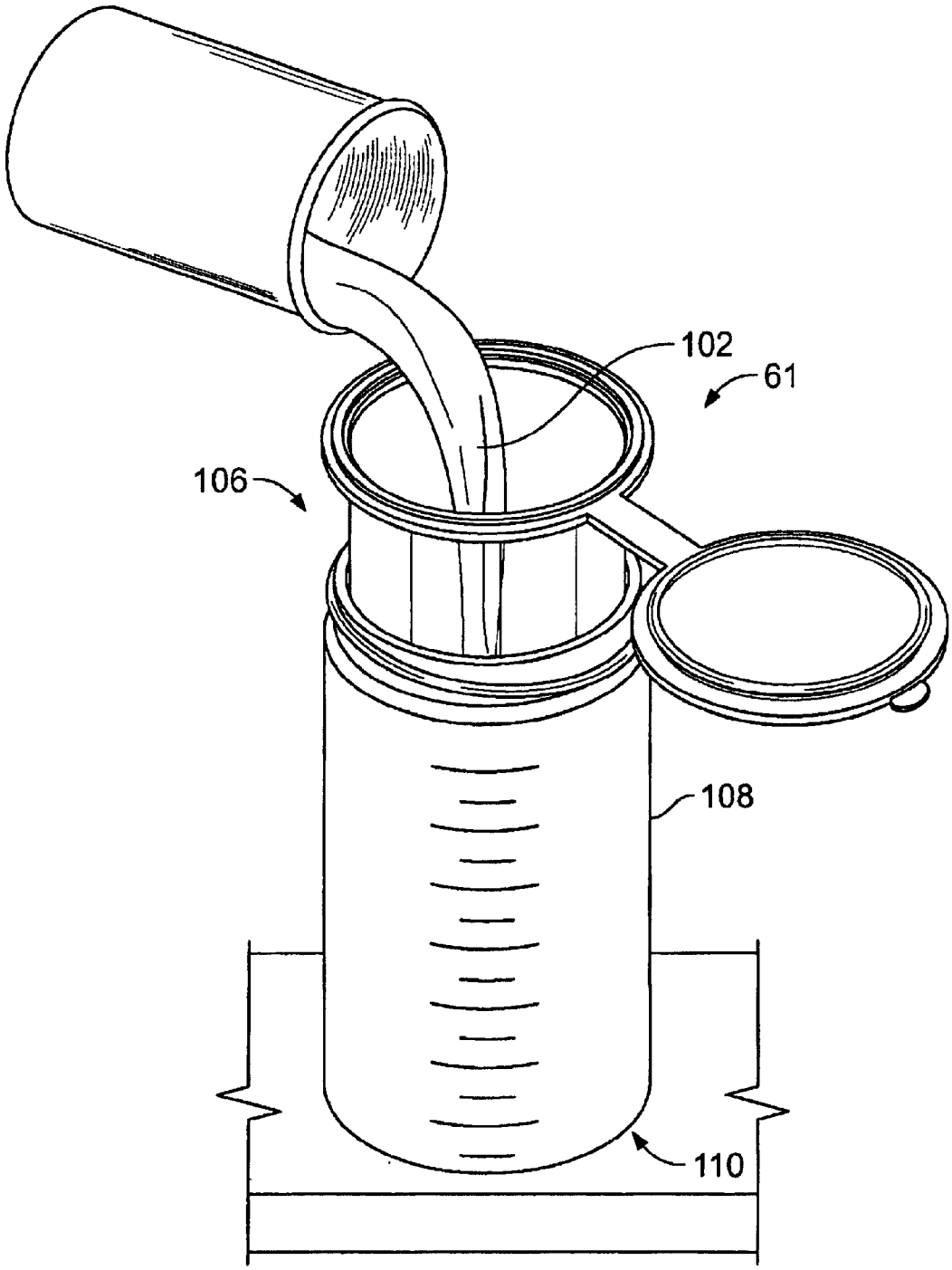
FIG. 10 shows an example of breast milk being poured into a milk storage bag.
Figure 11:
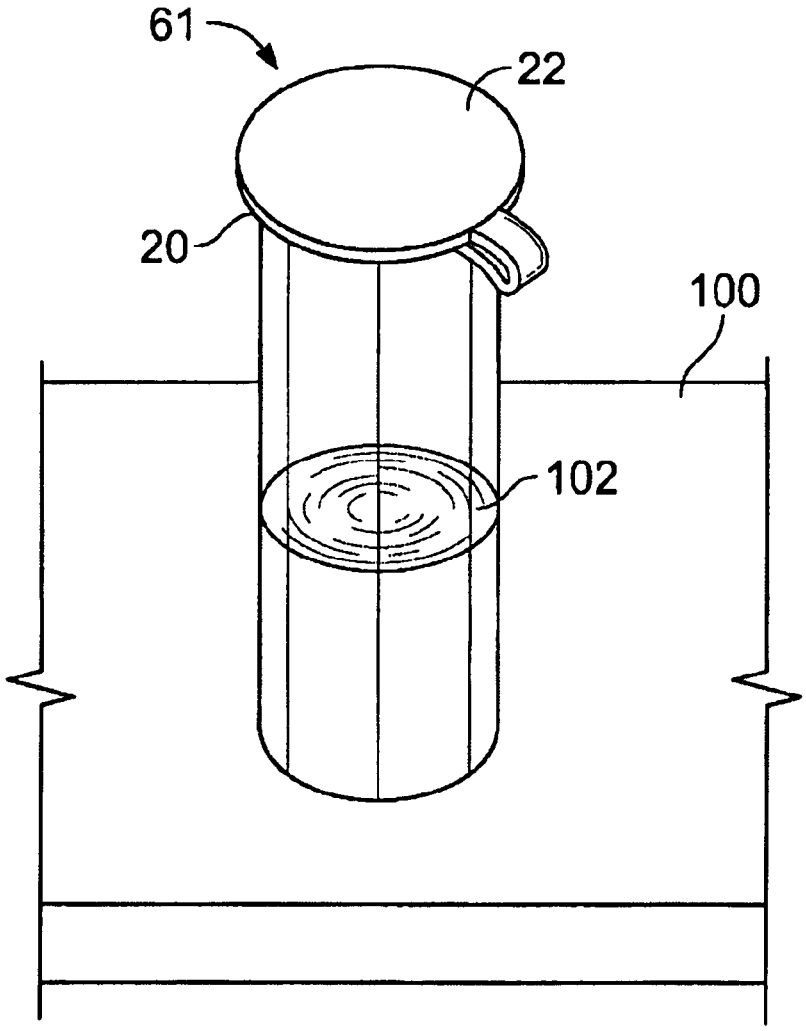
FIG. 11 shows an example of a milk storage bag containing breast milk in a first orientation.

Referring to FIGS. 10–14, an example of a method of use is shown. Referring to FIGS. 10–11, a user removes a single milk storage bag from a nested group 70 of storage bags. Storage bag 61 is placed in an open end 106 of a nursing tube 108. Nursing tubes are well known and are primarily characterized by having a first open end 106 and an opposing open end 110 to allow the a storage bag to collapse under atmospheric pressure during nursing. Alternatively, storage bag 61 could be placed in an appropriately sized nursing bottle (not shown), which are also well known and characterized by an open end and an opposing closed end. Both nursing tubes and nursing bottles may be combined with a nursing nipple and collar to form a feeding device.

A user pours breast milk 102, collected in a container from a device such as a breast pump, into storage bag 61, which is supported by nursing tube 108. Thus, the user may pour the breast milk with one hand while holding an infant with the other. The user then seals storage bag 61 by pressing lid 22 into rim 20 until sealing ring 50 is pressed through sealing ring 40. Storage bag 61 containing milk 102 is then removed from nursing tube 108 and may be stored in a refrigerator or freezer in any position.

Figure 12:
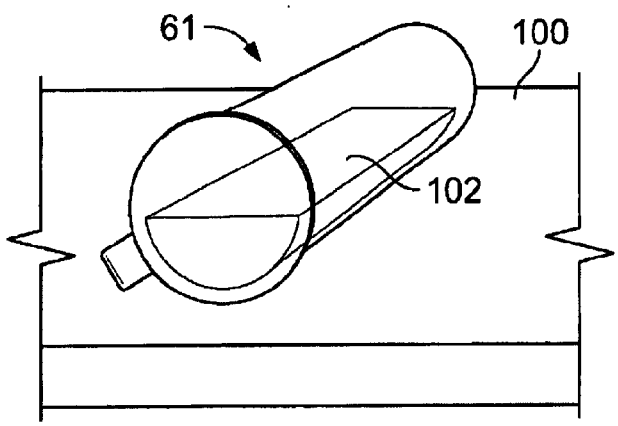
FIG. 12 shows an example of a milk storage bag containing breast milk in a second orientation.
Figure 13:
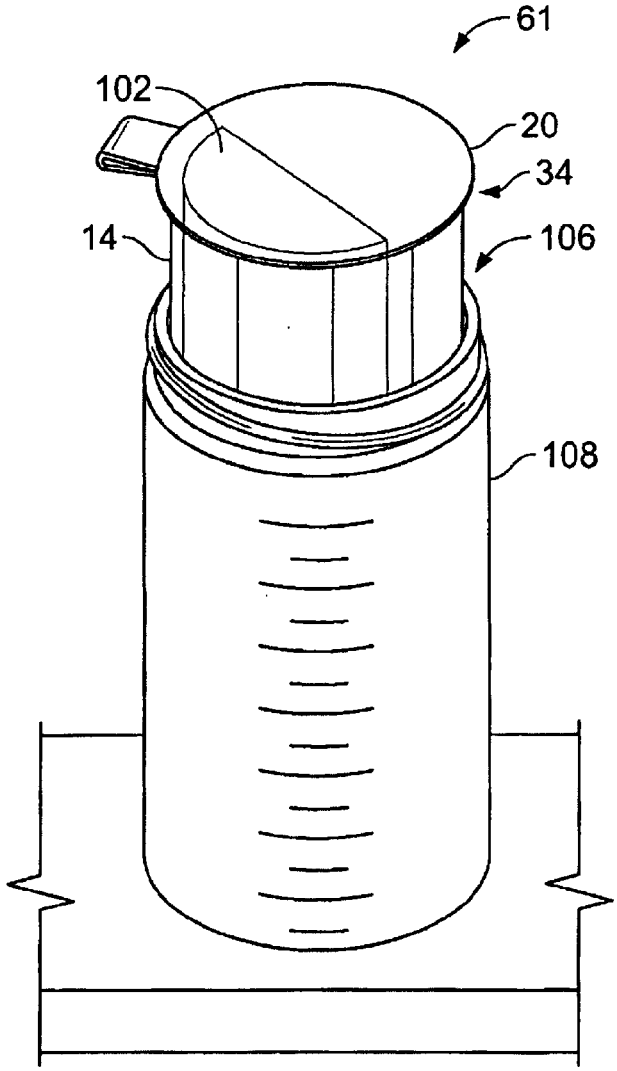
FIG. 13 shows an example of frozen breast milk contained in a milk storage bag being placed in a feeding device.
Figure 14:
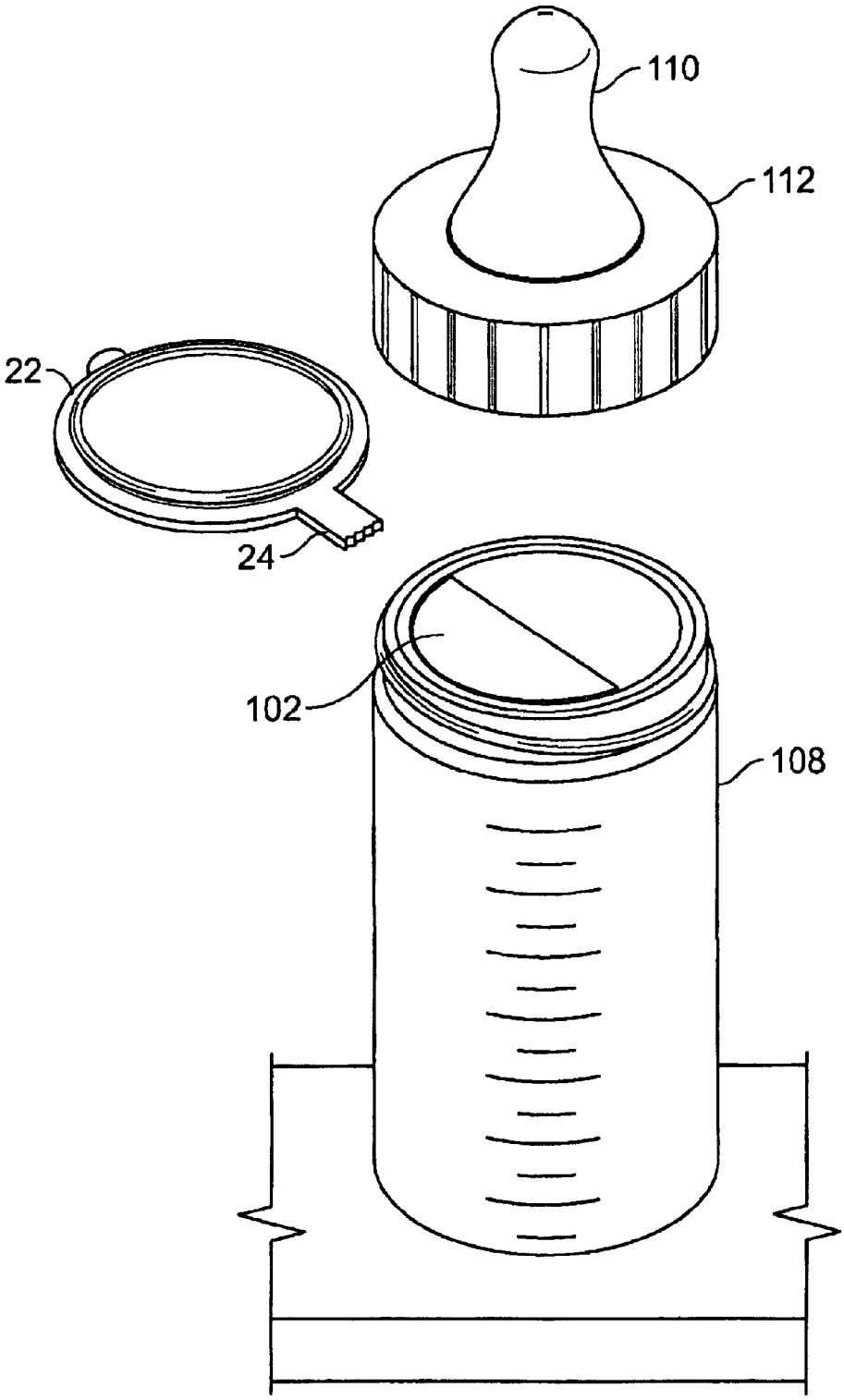
FIG. 14 shows assembly of a feeding device including a milk storage bag.

Referring to FIGS. 11–13, storage bag 61 is shown after having been stored in a freezer (not shown) in a generally horizontal position and is ready to be used for nursing.

Storage bag 61 is placed into opening 106 of a nursing tube 108. Alternatively, storage bag 61 could be placed in a nursing bottle. Opening 106 is sized to permit body 14 to pass into nursing tube 108 and to support lower surface 34 of rim 20. User opens storage bag 61 by removing lid 22 from rim 20. User then removes lid 22 from storage bag 61 by tearing tether 24 and attaches a nursing nipple 110 and a collar 112 to nursing tube 108 in order to warm milk 102 and begin nursing.

A number of embodiments of the invention have been described. Nevertheless, it will be understood that various modifications may be made without departing from the spirit and scope of the invention. For example, lid 22 and rim 20 may be formed separately and without any kind of tethering instead of being integrally formed. Accordingly, other embodiments are within the scope of the following claims.

What is claimed is:

1. A method of nursing comprising:

filling a bottle liner with milk, said bottle liner comprising a container comprising a flexible bag forming a tube with a generally flat bottom end and an open top end and a circular flange extending about the open end of the bag along an upper portion thereof and defining a fixed opening at the open end of the bag, the container having an inner surface extending from the bottom end of the bag and including a surface of the flange defining the fixed opening, and a lid comprising a wall projecting from a bottom surface thereof and configured to fit within the opening and a sealing ring having a diameter larger than the diameter of the opening and extending radially outward from the wall, the sealing ring being configured to fit within the fixed opening of the flange and form a fluid-tight seal with the inner surface of the container;

inserting the container into a nursing device;

opening the lid to expose the milk; and securing a nursing nipple to the nursing device with the container disposed therein.

2. The method of claim 1, wherein the lid is integrally attached to the flange.

3. The method of claim 2 further comprising removing the lid from the container.

4. The method of claim 1 further comprising storing the milk in the flexible container for a period of time in between filling the container and opening the lid.

5. The method of claim 1 further comprising freezing the milk.

6. The method of claim 1, wherein filling comprises inserting an empty container into a breast pump and extracting milk from a breast into the container.

7. The method of claim 1, wherein the flange comprises an upper surface, a sealing lip disposed on the upper surface configured to form a fluid seal with the nursing nipple, and a ring projecting inwardly from the inner surface to define the fixed opening.

8. A nursing bottle comprising:

a nursing nipple;

a liner comprising:

a container comprising:

a flexible bag forming a tube with a generally flat bottom end and an open top end;

a circular flange extending about the open end of the bag along an upper portion thereof and defining a fixed opening at the open end of the bag;

an inner surface extending from the bottom end of the bag including a surface of the flange defining the fixed opening;

a lid comprising a wall projection film a bottom surface and configured to fit within the fixed opening and a sealing ring having a diameter larger than a diameter of the opening and extending radially outward from the wall, the sealing ring being configured to fit within the fixed opening of the flange and form a fluid-tight seal with the inner surface of the container;

a rigid holder disposed about the liner and having a shoulder supporting the lower surface of the flange; and a removable collar attached to the holder to secure the flange and the nipple and permitting fluid communication between the liner and the nipple.

9. The nursing bottle of claim 8, wherein the flange comprises an upper surface and a sealing lip disposed on the upper surface configured to form a fluid seal with the nursing nipple.

10. A disposable drop-in bottle liner sized to fit within a baby bottle, the liner comprising:

a container comprising:

a flexible bag forming a tube with a generally flat bottom end and an open top end;

a circular flange extending about the open end of the bag along an upper portion thereof and defining a fixed opening at the open end of the bag;

an inner surface extending from the bottom end of the bag and including a surface of the flange defining the fixed opening; and a lid comprising a wall projecting from a bottom surface thereof and configured to fit within the opening and a sealing ring extending radially outward, the sealing ring being configured to fit within the fixed opening of the flange and form a fluid-tight seal with the inner surface of the container.

11. The bottle liner of claim 10 wherein the lid comprises a lower surface and the sealing ring is spaced apart from the lower surface, such that the fluid-tight seal between the sealing ring and the inner surface is substantially formed at a position at which the bag has a thickness of about 0.00275 inches.

12. The bottle liner of claim 10 wherein the flange further comprises a ring projecting inwardly from the inner surface to define the fixed opening.

13. The bottle liner of claim 10 wherein the flange further comprises a sealing ridge disposed on and projecting from an upper surface of the flange and configured to flange fluid-tight seal with a nipple.

14. The bottle liner of claim 10 wherein the lid is integrally connected to the flange by a living hinge.

15. The bottle liner of claim 10 wherein the lid is integrally connected to the flange by a tether.

16. The bottle liner of claim 10 wherein the wall of the lid and the opening bounded by the inner surface of the flange are substantially circular.

* * * * *

UNITED STATES PATENT AND TRADEMARK OFFICE

CERTIFICATE OF CORRECTION

PATENT NO. : 6,910,594 B2
APPLICATION NO. : 10/299968
DATED : June 28, 2005
INVENTOR(S) : Richard M. Foley and James J. Britto It is certified that error appears in the above-identified patent and that said Letters Patent is hereby corrected as shown below:

Column 6, Line 52 after “to” and before “fluid-tight” delete “flange” and insert -- form a --

Signed and Sealed this

Twenty-second Day of August, 2006

JON W. DUDAS
*Director of the United States Patent and Trademark Office*